US012781756B2

(12) United States Patent
Henderson et al.

(10) Patent No.: US 12,781,756 B2
(45) Date of Patent: Nov. 3, 2026

(54) LABYRINTH PROTECTOR FOR ELECTRIC SUBMERSIBLE PUMPS

(71) Applicant: Schlumberger Technology Corporation, Sugar Land, TX (US)

(72) Inventors: Andrew Henderson, Aberdeen (GB); Calum Crawford, Aberdeen (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/243,023

(22) Filed: Jun. 19, 2025

(65) Prior Publication Data

US 2026/0078766 A1 Mar. 19, 2026

(30) Foreign Application Priority Data

Jun. 27, 2024 (GB) ..... 2409294

(51) Int. Cl.
*F04D 29/08* (2006.01)
*E21B 43/12* (2006.01)
*F04D 13/08* (2006.01)

(52) U.S. Cl.
CPC ..... *F04D 29/086* (2013.01); *E21B 43/128* (2013.01); *F04D 13/086* (2013.01)

(58) Field of Classification Search
CPC ..... F04D 29/086; F04D 13/08; F04D 29/426
See application file for complete search history.

(56) References Cited

U.S. PATENT DOCUMENTS

| | | | | |
|---|---|---|---|---|
| 3,384,769 | A * | 5/1968 | Schaefer | H02K 5/1285 310/90 |
| 6,276,458 | B1 * | 8/2001 | Malone | E21B 34/06 166/240 |
| 6,688,935 | B1 * | 2/2004 | Lin | A63H 33/28 446/16 |
| 7,741,744 | B2 * | 6/2010 | Watson | E21B 43/128 310/87 |
| 10,928,841 | B2 * | 2/2021 | Tanner | E21B 43/128 |
| 11,493,048 | B2 | 11/2022 | MacIver | |
| 2011/0014071 | A1 * | 1/2011 | Du | F04D 13/10 417/414 |
| 2016/0312591 | A1 * | 10/2016 | Pyron | F04D 13/062 |

FOREIGN PATENT DOCUMENTS

CN 212818630 U * 3/2021

OTHER PUBLICATIONS

English Machine Translation of CN-212818630-U (Year: 2021).*

* cited by examiner

*Primary Examiner* — Nathan C Zollinger

(57) ABSTRACT

A protector for an electric submersible pump system has a pressure resistant housing and a mandrel sealingly engaged with an interior of the housing to define a fluid tight chamber in an annular space between the housing and the mandrel. The mandrel has a fluid port at one longitudinal end. A labyrinth tube is in sealed fluid communication with the fluid port, and is wound around the mandrel to longitudinally traverse the mandrel toward another longitudinal end thereof and back toward the fluid port. An end of the labyrinth tube is fluidly exposed in the fluid tight chamber.

17 Claims, 5 Drawing Sheets

LABYRINTH PROTECTOR FOR ELECTRIC SUBMERSIBLE PUMPS

CROSS-REFERENCE TO RELATED APPLICATION(S)

The present disclosure claims priority from GB Appl. No. 2409294.2, filed on Jun. 27, 2024, herein incorporated by reference in its entirety.

BACKGROUND

This disclosure relates to the field of pumps used in subsurface wells such as electric submersible pumps (ESPs). More particularly the disclosure relates to protectors used to keep separated well fluid from dielectric fluid, such as motor oil, in which an electric motor in an ESP is disposed.

Fluid within an electrical submersible pump (ESP) is at atmospheric pressure prior to the ESP being inserted into a subsurface well. Because well pressure often substantially exceeds atmospheric pressure, the fluid pressure within the ESP should be equalized to well pressure. Pressure equalization reduces pressure differential across the ESP housing and seals, particularly rotating shaft seals. A hazard of differential pressure in an ESP is that well fluid could breach such seals and leak into the electric motor portion of the ESP. This is of special concern with regard to the motor, where the well fluids, which are often electrically conductive and may have solid particles therein could create electrical short circuits and/or mechanically damage the motor. A device known as a protector (also referred to as a "seal chamber section") communicates well fluid pressure to the motor fluid pressure while substantially separating the well fluid and motor fluid from each other, thereby minimizing pressure differential and prolonging seal life. To perform such function, the protector contains a pressure compensation device to act as a barrier to well fluid entering the drive train part of the ESP (i.e., components proximate to and including the motor) while still transmitting the pressure from the well fluid to the drive train. A protector may have a tortuous fluid path that slows down the migration of well fluid through the protector to reduce the chance of well fluid entering the drivetrain through any leak in the pressure compensating device or mechanical seal.

U.S. Pat. No. 11,493,048 issued MacIver et al. describes a labyrinth type protector. While effective, the protector disclosed in the '048 patent can be lengthy and require costly manufacturing processes to make. There is a need for ESP protectors that can be made more simply and inexpensively, while traversing shorter length.

SUMMARY

One aspect of the present disclosure relates to a protector for an electric submersible pump system. A protector according to this aspect has a pressure resistant housing and a mandrel sealingly engaged with an interior of the housing to define a fluid tight chamber in an annular space between the housing and the mandrel. The mandrel has a fluid port at one longitudinal end. A labyrinth tube is in sealed fluid communication with the fluid port, and is wound around the mandrel to longitudinally traverse the mandrel toward another longitudinal end thereof and back toward the fluid port. An end of the labyrinth tube is fluidly exposed in the fluid tight chamber.

In some implementations, the labyrinth tube comprises elastomer.

In some implementations, the labyrinth tube comprises corrugated metal.

In some implementations, the mandrel defines a through bore.

In some implementations, comprising a retaining sleeve disposed proximate the other longitudinal end of the mandrel to retain the labyrinth tube.

Some implementations further comprise an adapter sealingly disposed in a longitudinal end of the housing wherein the fluid port is disposed in the mandrel, the adapter sealingly engaged with the fluid port.

Some implementations further comprise an adapter sealingly disposed in a longitudinal end opposed to a longitudinal end wherein the fluid port is disposed in the mandrel.

An electric submersible pump (ESP) system according to another aspect of the present disclosure includes a motor, a pump rotationally connected to the motor by a drive shaft, and a protector according to any of the previous aspects herein disposed longitudinally between the pump and the motor.

In some implementations, the motor comprises an electric motor.

In some implementations, the pump comprises a rotary pump.

A method for isolating well fluid from a motor in an electric submersible pump (ESP) system according to another aspect of the present disclosure includes disposing a protector between a motor and a pump of an ESP system. The protector comprises a pressure resistant housing, and a mandrel sealingly engaged with an interior of the housing to define a fluid tight chamber in an annular space between the housing and the mandrel. The mandrel has a fluid port at one longitudinal end, and a labyrinth tube in sealed fluid communication with the fluid port. The labyrinth tube is wound around the mandrel to longitudinally traverse the mandrel toward another longitudinal end thereof and back toward the fluid port, an end of the labyrinth tube fluidly exposed in the fluid tight chamber.

In some implementations, the labyrinth tube comprises elastomer.

In some implementations, the labyrinth tube comprises corrugated metal.

In some implementations, the mandrel defines a through bore.

Some implementations further comprise a retaining sleeve disposed proximate the other longitudinal end of the mandrel to retain the labyrinth tube.

Some implementations further comprise an adapter sealingly disposed in a longitudinal end of the housing wherein the fluid port is disposed in the mandrel, the adapter sealingly engaged with the fluid port.

Some implementation further comprise an adapter sealingly disposed in a longitudinal end opposed to a longitudinal end wherein the fluid port is disposed in the mandrel.

Other aspects and possible advantages will be apparent from the description and claims that follow.

DETAILED DESCRIPTION

Figure 1:
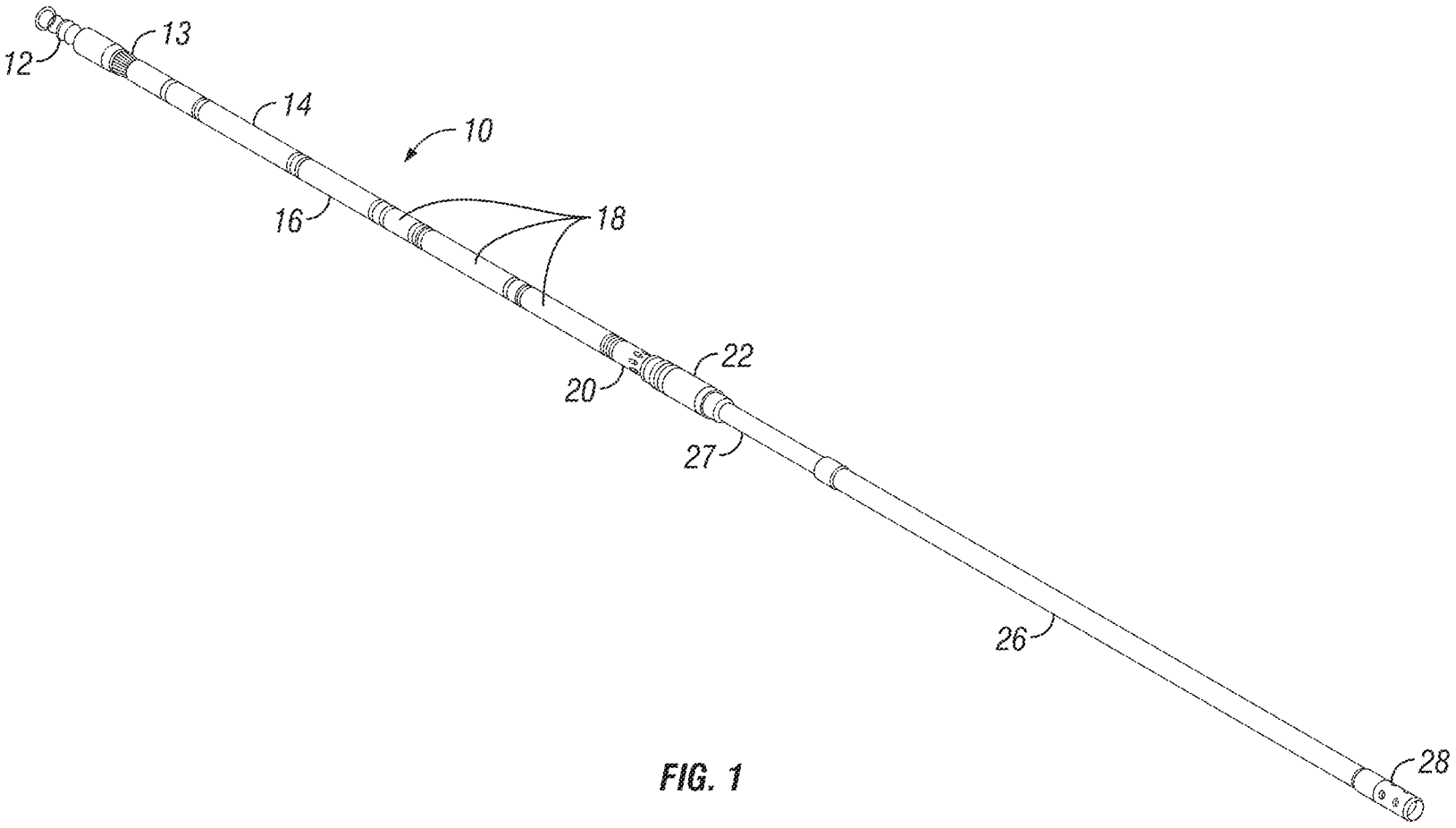
FIG. 1 shows an example implementation of an electric submersible pump (ESP) system having a labyrinth seal according to the present disclosure.

FIG. 1 shows an example implementation of an electric submersible pump (ESP) system 10 that may be conveyed into a well (not shown) using a conveyance such as, for example and without limitation, jointed tubing, wireline, slickline or coiled tubing. The ESP system 10 may include an upper or "top" sub 12 that is configured to make connection to an end of one of the foregoing conveyance devices for movement of the ESP system 10 into and out of the well (not shown). A lower end of the ESP system 10 may include a "muleshoe" sub 28. The muleshoe sub 28 may be added below a pump 26, e.g., a rotary pump such as a progressive cavity pump or centrifugal pump, to provide protection to the ESP system 10 while running it into the well during deployment, and to provide, e.g., a mounting location for a pump (ESP) intake memory gauge. In addition, the muleshoe sub 28 may provide a suitable location for inner bore sealing as part of a well barrier control mechanism (not shown). Both a single shot sealing option, and a pressure responsive valve with multiple stable positions may be considered as suitable example options for well sealing below the muleshoe sub 28. For purposes of this disclosure, the terms "up" and "above" are intended to mean in a direction toward the outlet or surface end of a wellbore, while "down" and "below" are intended to mean in the opposite direction. Corresponding terms used herein may include "upper end" and "lower end" with reference to various modules or sections that make up the ESP system 10. It is to be understood that such reference is only for convenience in describing the various components of the ESP system 10 and is not intended to limit the arrangement of components of any other ESP or ESP system within the scope of the present disclosure.

The top sub 12 may be followed successively in one direction by a "star point sub" 13 and a motor 14, which in the present example may be an electric motor. The star point sub 13 may include one or more sensors and control devices related to operation of the ESP system 10 and the motor 14. The star point sub 13 may also be used to make electrical connection between a cable (not shown) and the motor 14. The motor 14 may be coupled at its lower end and its rotary output to an enclosed flexible shaft, a magnetic gear or any other rotational motion transmission 16. In the present example, the rotational motion transmission 16 accepts rotational input from the motor, and transmits such rotation to a pump 26, which may be a rotary pump such as a centrifugal pump or progressive cavity pump. A protector 18 may be disposed in the ESP system 10 longitudinally between the motor 14 and the pump 26, and may be configured to exclude well fluid at existing well pressure and temperature from entering the motor 14. The protector 18 may also axially decouple the rotational motion transmission 16 and the motor 14 from axial and lateral loading generated by the pump 26. Not shown in FIG. 1 for clarity, the ESP system 10 may comprise a flow shroud that diverts well fluid flow from the pump outlet so that it can travel in an annular space outside the ESP system 10 and be sealingly diverted into a jointed tubing or coiled tubing and thence flow upwardly in the well (not shown).

The present example of ESP system 10 may be of modular design, and for deployment enable first lowering the pump 26, including the muleshoe sub 28 and an optional flex sub 27 to enable relative axial deflection between the upper components, terminating at a field coupling sub 22 coupled to the upper end of a pump discharge sub 20, and thence coupled to a lower end of the protector 18 and the components described above. The pump 26, the flex sub 27, the pump discharge sub 20 and the field coupling sub 22 may be inserted into the well first, to be followed by the foregoing described components beginning with the field coupling sub 22. The entire ESP system 10 may also be lowered into the well as an assembled unit. The pump 26, the flex sub 27, the protector 18, the rotary motion transmission 16, the motor 14 and the star point sub 13 may each be enclosed in a respective pressure resistant housing, and such housings may be coupled by threads, locking rings or any other device known in the art for joining housings or housing segments of well tools together end to end.

As will be appreciated by those skilled in the art, a part of the ESP system 10 in which the motor 14 is disposed may be filled with dielectric fluid such as oil. The protector 18 may serve to exclude well fluid, which will be present both inside and outside the section of the ESP system 10 comprising the pump 26 from entering the motor 14 section and components above the motor section. Description to follow relates to a labyrinth seal that may be disposed in the protector 18.

Figure 2:
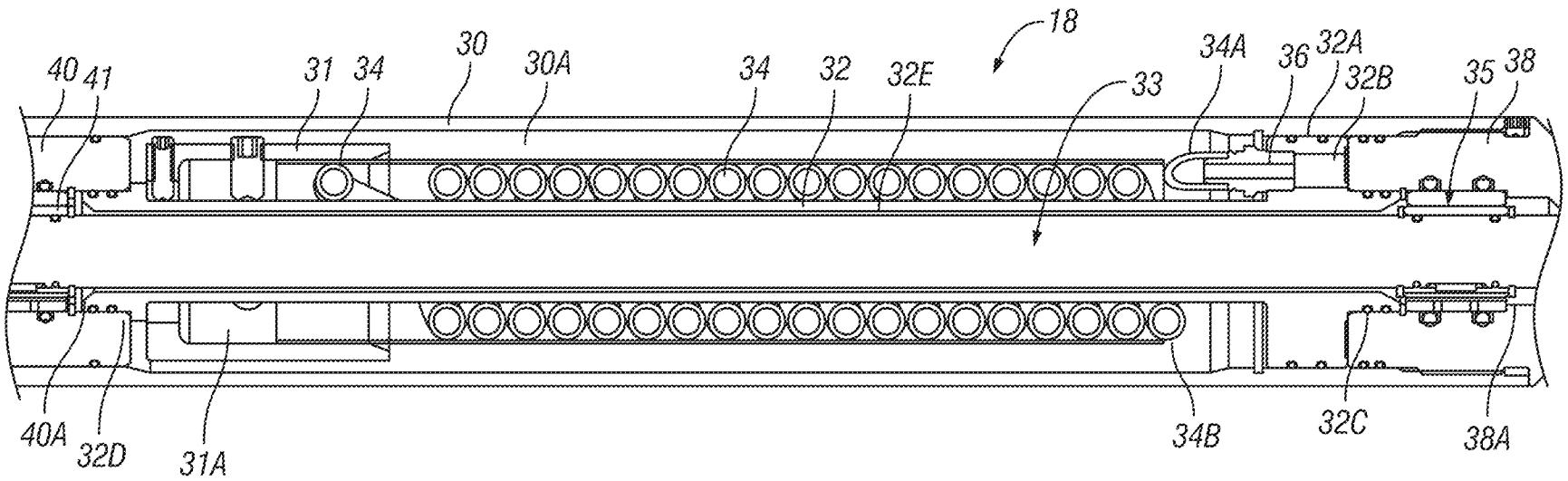
FIG. 2 shows a cross section view of an example implementation of a labyrinth seal section that may be used with the ESP system of FIG. 1.

An example implementation of a protector 18 according to the present disclosure is shown in cross section view in FIG. 2. The protector 18 may comprise a pressure resistant housing 30 in which may be disposed a mandrel 32. A lower adapter 38 may be disposed at one longitudinal end of the housing 30 and may sealingly enclose the longitudinal end of the housing 30. The lower adapter 38 may sealingly engage to components of the ESP system (10 in FIG. 1) in the direction of the pump (26 in FIG. 1) as explained with reference to FIG. 1, or may form part of a housing for such other components. An upper adapter 40 may be sealingly engaged with the other longitudinal end of the housing 30 and may close the other longitudinal end of the housing 30. Both adapters 38, 40 may comprise a respective through bore 38A, 40A, each of which may enable passage therethrough of a drive shaft 33 (explained further below). The mandrel 32 may also have a through bore 32E for the drive shaft 33.

The housing 30, the adapters 38, 40 and the mandrel 32 define a fluid tight interior chamber 30A in the annular space between the housing 30 and the mandrel 32, in which components of the labyrinth seal may be disposed. An interior of the mandrel 32 may provide space for a drive shaft 33 to pass through the protector 18 in order to transmit rotation, ultimately from the motor (14 in FIG. 1) to the pump (26 in FIG. 1). One or more bearings 35 may be disposed in the lower adapter 38 to rotatably support the drive shaft 33. Similarly, one or more bearings 41 may be disposed in the upper adapter 40 to rotatably support the drive shaft 33.

Figure 3:
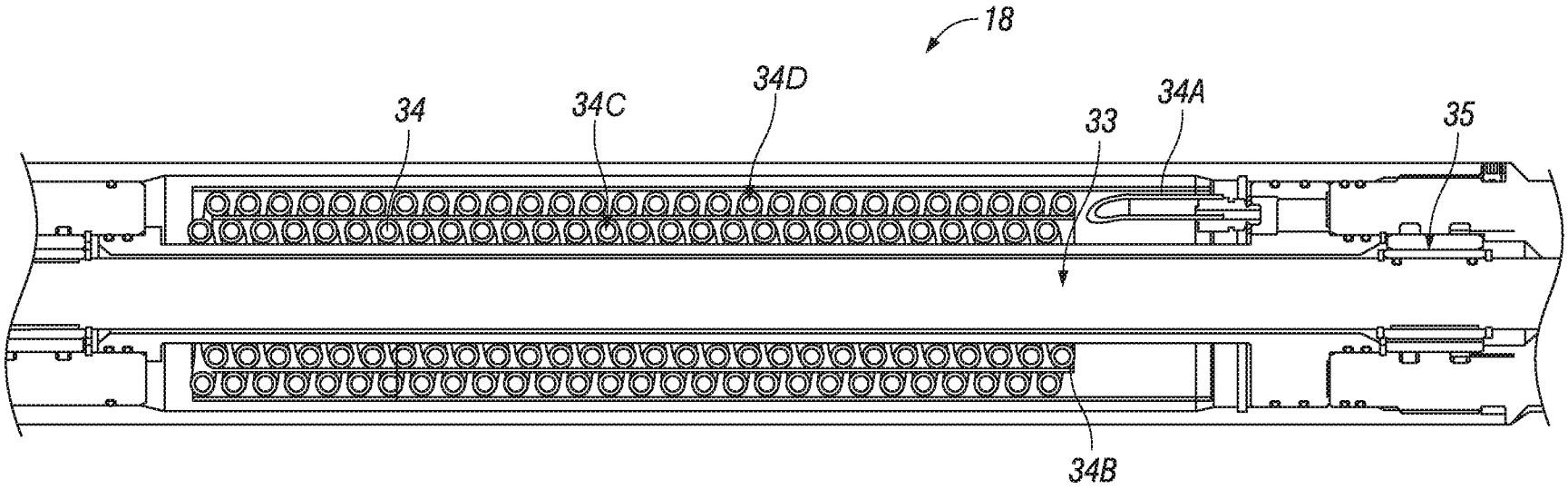
FIG. 3 shows a cross section view of an example implementation of a labyrinth seal according to the present disclosure

One longitudinal end of the mandrel 32 may comprise a bulkhead 32A to sealingly engage the interior wall of the housing 30 and a seal extension 32C to sealingly engage the lower adapter 38. The bulkhead 32A may comprise a fluid port 32B into which a tubing connector 36 may be sealingly inserted. The other longitudinal end of the mandrel 32 may comprise a flange and seal extension 32D to sealingly engage the upper adapter 40. The tubing connector 36 is connected to one end 34A of a labyrinth tube 34. The labyrinth tube 34 may be made from elastomer or plastic able to withstand the temperature and fluids in a well into which the ESP system (10 in FIG. 1) is disposed. In some example implementations, the labyrinth tube 34 may be made from corrugated metal, e.g., stainless steel. Some examples of metal labyrinth tube 34 may comprise a small diameter metal tube wound into the shape of a longitudinally extensive helical coil, wherein the helical coil may be wound as shown in FIG. 2. In FIG. 2, the labyrinth tube 34 may be wound around the mandrel 32, e.g., helically, extending between the bulkhead 32A and the flange/seal extension 32D, and may then be wound, e.g., helically, from the flange/seal extension 32D in a direction toward the lower adapter 38. In the example implementation shown in FIG. 2, the labyrinth tube 34 may be wound in one or more layers, a single layer being shown in FIG. 2. In FIG. 3, in which the components are the same as those in FIG. 2, the helical winding may be in two or more layers, such being shown at 34C and 34D. In some example implementations a retaining sleeve 31 may be disposed about the mandrel 32 proximate one longitudinal end to retain the labyrinth tube 34 onto the mandrel 32 at the position where the wind of the labyrinth tube reverses. The retaining sleeve 31 may be approximately U shaped to define an interior space 31A wherein the labyrinth tube 34 may be disposed where the winding direction reverses. In some examples, such as using elastomer tubing for the labyrinth tube 34, the retaining sleeve 31 may be omitted.

The lower adapter 38 may comprise a longitudinal through port (not shown) to enable well fluid communication through the lower adapter 38, through the fluid port 32B in the lower adapter 38 and thereby into the labyrinth tube 34.

In some examples, the other end 34B of the labyrinth tube 34 may be open and disposed proximate the bulkhead 32A such that the labyrinth tube 34 acts as a dip tube. That is, well fluid entering the labyrinth tube 34 from below the bulkhead 32A, to the extent such fluid fully fills the labyrinth tube 34 and exits through the other end 34B, will tend to settle in the bottom of the chamber 30A proximate to the bulkhead 32A. In this way, fluid movement across the upper adapter 40 will for as long as possible exclude well fluid and remain fully in oil or other dielectric fluid, thereby reducing possibility of well fluid entering the motor (see 14 in FIG. 1) when it is disposed above the protector 18.

Figure 4:
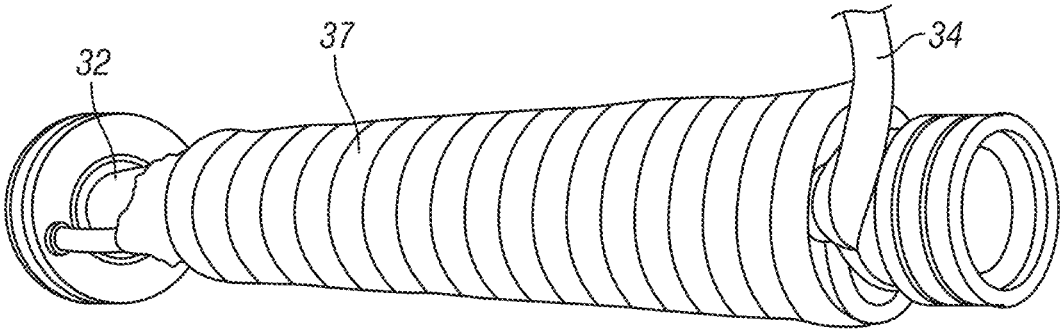
FIG. 4 shows an oblique view of a mandrel portion of an example implementation of a labyrinth seal according to the present disclosure.
Figure 5:
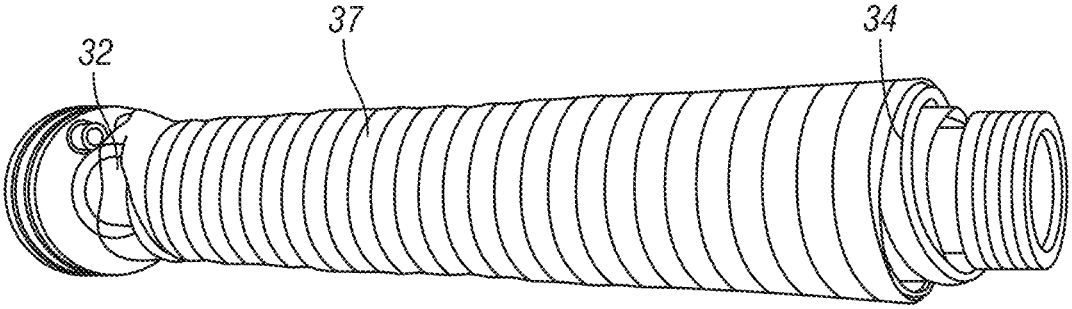
FIG. 5 shows an oblique view of a mandrel section of an example implementation of a labyrinth seal according to the present disclosure.

FIG. 4 shows the mandrel 32 with the labyrinth tube 34 wound as explained with reference to FIG. 2. The example shown in FIG. 4 may include a covering 37 disposed around the exterior of the wound labyrinth tube 34. The covering may be, for example and without limitation, elastomer sheet, heat shrinkable tubing or tape capable of withstanding the temperature and fluids in which the ESP system (10 in FIG. 1) will be disposed. FIG. 5 shows the mandrel as explained with reference to FIG. 3, again with a covering 37 around the exterior of the wound labyrinth tube 34.

Figure 6:
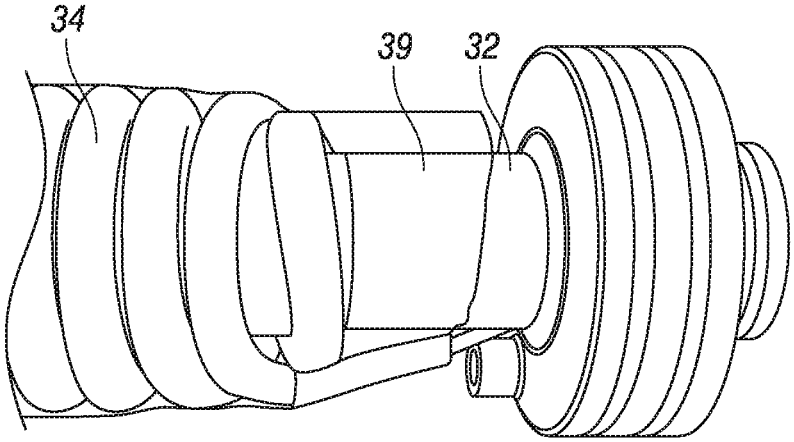
FIG. 6 shows an enlarged view of one end of the labyrinth seal of FIG. 4.

FIG. 6 shows an enlarged view of one end of the mandrel 32 for the example of FIG. 5, in which the end of the labyrinth tube 34 may be covered with protective tape or sheeting 39.

Figure 7:
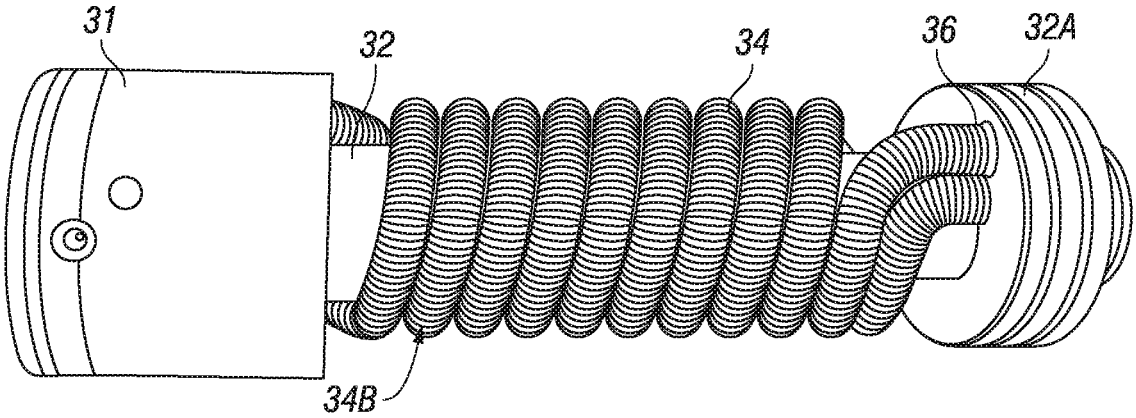
FIG. 7 shows a side oblique view of a mandrel section of an example implementation of a labyrinth seal according to the present disclosure.
Figure 8:
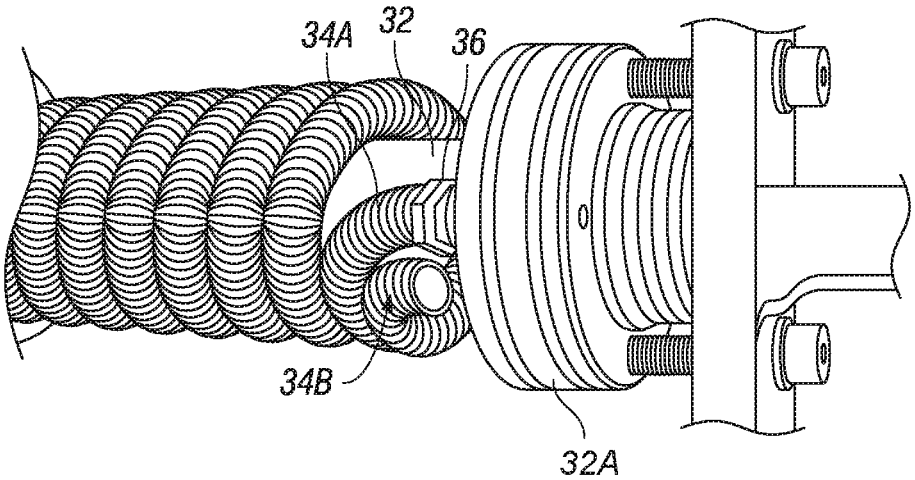
FIG. 8 shows an enlarged view of one end of the example implementation of FIG. 7.

FIGS. 7 and 8 show an example implementation of a mandrel 32 and labyrinth tube 34 wherein the labyrinth tube 34 may be made from metal, e.g., stainless steel in the form of corrugated tube. The corrugated tube 34 may be wound around the mandrel 32 in a manner similar to that explained with reference to FIGS. 2 and 3. FIG. 8 shows the one end 34A of the labyrinth tube 34 attached to the tubing connector 36, and the other end 34B of the labyrinth tube 34 disposed proximately in order to perform as a dip tube.

It is contemplated that an ESP system as explained with reference to FIG. 1 may comprise other devices such as shaft seals and motor oil storage reservoirs of types well known in the art. It will be appreciated that the orientations of the components described with reference to FIGS. 2 through 8 would be as used with an ESP system having a motor located above the pump as shown in FIG. 1. In some examples, wherein the ESP system comprises the motor being below the pump, certain devices and features may be in different positions and orientations to address such ESP system structure.

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

What is claimed is:

1. A protector for an electric submersible pump system, comprising:

a pressure resistant housing;

a mandrel sealingly engaged with an interior of the housing to define a fluid tight chamber in an annular space between the housing and the mandrel, the mandrel having a fluid port at one longitudinal end; and a labyrinth tube in sealed fluid communication with the fluid port, the labyrinth tube helically wound around the mandrel to longitudinally traverse the mandrel toward another longitudinal end thereof and helically wound around the mandrel back toward the fluid port, an end of the labyrinth tube fluidly exposed in the fluid tight chamber.

2. The protector of claim 1 wherein the labyrinth tube comprises elastomer.

3. The protector of claim 1 wherein the labyrinth tube comprises corrugated metal.

4. The protector of claim 1 wherein the mandrel defines a through bore.

5. The protector of claim 1 further comprising a retaining sleeve disposed proximate the other longitudinal end of the mandrel to retain the labyrinth tube.

6. The protector of claim 1 further comprising an adapter sealingly disposed in a longitudinal end of the housing wherein the fluid port is disposed in the mandrel, the adapter sealingly engaged with the fluid port.

7. The protector of claim 1 further comprising an adapter sealingly disposed in a first longitudinal end of the housing opposed to a second longitudinal end of the housing wherein the fluid port is disposed in the mandrel.

8. An electric submersible pump (ESP) system, comprising:

a motor;

a pump rotationally connected to the motor by a drive shaft; and a protector according to any of claims 1 through 7 disposed longitudinally between the pump and the motor.

9. The ESP system of claim 8 wherein the motor comprises an electric motor.

10. The ESP system of claim 8 wherein the pump comprises a rotary pump.

11. A method for isolating well fluid from a motor in an electric submersible pump (ESP) system, comprising:

disposing a protector between a motor and a pump of an ESP system, the protector comprising a pressure resistant housing, a mandrel sealingly engaged with an interior of the housing to define a fluid tight chamber in an annular space between the housing and the mandrel, the mandrel having a fluid port at one longitudinal end, and a labyrinth tube in sealed fluid communication with the fluid port, the labyrinth tube helically wound around the mandrel to longitudinally traverse the mandrel toward another longitudinal end thereof and helically wound around the mandrel back toward the fluid port, an end of the labyrinth tube fluidly exposed in the fluid tight chamber.

12. The method of claim 11 wherein the labyrinth tube comprises elastomer.

13. The method of claim 11 wherein the labyrinth tube comprises corrugated metal.

14. The method of claim 11 wherein the mandrel defines a through bore.

15. The method of claim 11 further comprising a retaining sleeve disposed proximate the other longitudinal end of the mandrel to retain the labyrinth tube.

16. The method of claim 11 further comprising an adapter sealingly disposed in a longitudinal end of the housing wherein the fluid port is disposed in the mandrel, the adapter sealingly engaged with the fluid port.

17. The method of claim 11 further comprising an adapter sealingly disposed in a first longitudinal end of the housing opposed to a second longitudinal end of the housing wherein the fluid port is disposed in the mandrel.

* * * * *